US006453131B1

(12) United States Patent
Sasai

(10) Patent No.: US 6,453,131 B1
(45) Date of Patent: Sep. 17, 2002

(54) IMAGE FORMING APPARATUS AND WARM-UP METHOD

(75) Inventor: Takahiro Sasai, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/615,121

(22) Filed: Jul. 13, 2000

(30) Foreign Application Priority Data

Jul. 19, 1999 (JP) ..... 11-204367

(51) Int. Cl.[7] ..... G03G 15/20
(52) U.S. Cl. ..... 399/70; 399/127
(58) Field of Search ..... 399/70, 69, 330, 399/127, 128, 129; 219/216

(56) References Cited

U.S. PATENT DOCUMENTS 4,415,800 A * 11/1983 Dodge et al. ..... 219/497
4,480,908 A * 11/1984 Anzai et al.
4,618,247 A * 10/1986 Tsuji ..... 399/128
4,671,643 A * 6/1987 Shigemura et al. ..... 399/70
5,307,132 A * 4/1994 Tsuchiya ..... 399/70
5,412,453 A * 5/1995 Matsuo ..... 399/33
5,790,919 A * 8/1998 Lee ..... 399/43
6,038,412 A * 3/2000 Hiraoka ..... 399/69
6,308,022 B1 * 10/2001 Sasai ..... 399/70

FOREIGN PATENT DOCUMENTS

JP 56014244 A * 2/1981 ..... G03G/15/00
JP 01-282585 * 11/1989
JP 03-200184 * 9/1991
JP 4-250484 9/1992
JP 07219384 A * 8/1995 ..... G03G/15/20
JP 7-281573 10/1995

* cited by examiner

*Primary Examiner*—Robert Beatty
(74) *Attorney, Agent, or Firm*—Hogan & Hartson, LLP

(57) ABSTRACT

An electrophotographic image forming apparatus and method of controlling the apparatus during a warm-up operation. During the warm-up operation, a heating unit for heating a fuser will be turned on and a motor for starting rotation of a photosensitive body will be activated when the temperature of the fuser reaches a motor rotation start temperature. When the temperature of the fuser reaches a warm-up completion temperature, the warm-up operation will be stopped and the rotation of the photosensitive body will be terminated. The warm-up completion temperature is higher than a stand-by temperature but lower than a fusing temperature.

11 Claims, 4 Drawing Sheets

IMAGE FORMING APPARATUS AND WARM-UP METHOD

BACKGROUND OF THE INVENTION

1. Field of the Invention

The present invention relates to an electro-photographic type image forming apparatus and warm-up method for the same.

2. Description of the Related Art

When power is turned on in an electro-photographic type image forming apparatus, the apparatus first performs a warm-up operation (preparatory rotation of a photosensitive drum, and raising of the temperature of a fuser). The photosensitive drum may be rotated a predetermined number of times (two or three times, for example) in the preparatory rotation, and the fuser is heated until it reaches a predetermined stand-by temperature. Therefore, the preparatory rotation of the drum will end while the fuser is still being heated.

When the fuser reaches its stand-by temperature, application of heat to the fuser is discontinued. The fuser's heat may then be lost to the surrounding environment. This may cause the fuser temperature to drop below its stand-by temperature. If the start button is then pressed on the image forming apparatus, thereby directing the machine to perform an image recording operation, a certain time is required until the fuser temperature returns to the stand-by temperature. This causes the image recording operation to take long, and a user must wait long.

BRIEF SUMMARY OF THE INVENTION

It is an object of the present invention to provide an image processing apparatus capable of quickly performing a print-out operation even if the printout operation is requested after some time has passed since completion of the warm-up operation.

According to one aspect of the present invention, there is provided an electro-photographic type image processing apparatus that includes a heating unit that heats a fuser, a detection unit that detects the temperature of the fuser, and a control unit that stops performing the warm-up operation when the fuser reaches a warm up completion temperature that is higher than a stand-by temperature. When the fuser has been heated to the warm-up completion temperature, the atmosphere around the fuser has also been heated considerably, and the fuser does not lose its heat to its surrounding environment in a certain period. Since the warm up completion temperature is higher than the stand-by temperature, the fuser's temperature is still high (or close to the stand-by temperature) after completion of the warm-up operation. The image forming apparatus can therefore print out quickly even if a print start button is pressed some time after completion of the warming-up operation.

The fuser's warm-up completion temperature may be lower than it's fusing temperature. If so arranged, the image forming apparatus can print out quickly after the power is switched on.

The control unit may maintain the temperature of the fuser at the stand-by temperature after the fuser's temperature reaches the warm-up temperature. If so arranged, the image forming apparatus can reduce power consumption when it is in stand-by mode.

The control unit may stop the motor after completion of the warm-up operation. This can reduce wear-and- tear on the photosensitive drum.

The control unit may begin printing out image data without stopping the motor if a print signal (command) is given to the apparatus during the interval between the turning on of power and the fuser's reaching the warm-up completion temperature. This allows the printing to start quickly after power is switched on.

According to another aspect of the present invention, there is provided an electro-photographic image forming apparatus including an exposure unit for forming an electrostatic latent image on a photosensitive drum, a developer for forming a toner image by applying toner to the electrostatic latent image, a transferer for transferring the toner image onto a recording sheet, a fuser for fusing and fixing the transferred image onto the recording sheet, a heater for heating the fuser, a temperature detector for detecting temperature of the fuser, and a controller for adjusting the heater based on the detected temperature such that a warm-up operation is terminated when the fuser reaches a warm-up completion temperature that is higher than a stand-by temperature. Since the warm up completion temperature is higher than the stand-by temperature, the image forming apparatus can start a printing operation immediately or in a very short period anytime after the warm-up operation has been completed.

The warm-up completion temperature may be set to a temperature lower than the fusing temperature. This enables the image forming apparatus to rapidly perform a printing operation anytime after power has been turned on.

The controller may maintain the fuser at the stand-by temperature after completion of the warm-up operation. The image forming apparatus can reduce power consumption while the apparatus is in a stand-by mode.

The heating unit or heater is referred to as a heat lamp 101*a* in the detailed description, the temperature detection unit or detector is referred to as a temperature sensor 110, and the control unit or controller is referred to as MPU 11, ROM 12, and RAM 13.

BRIEF DESCRIPTION OF THE SEVERAL VIEWS OF THE DRAWINGS

FIG. 4 is a flow chart showing the operation of the facsimile machine of FIG. 1 after power is turned on.

DETAILED DESCRIPTION OF THE INVENTION

An embodiment of the image forming apparatus of the present invention will now be described with reference to the accompanying drawings. This embodiment will describe the image forming apparatus as a facsimile machine 1.

Figure 1:
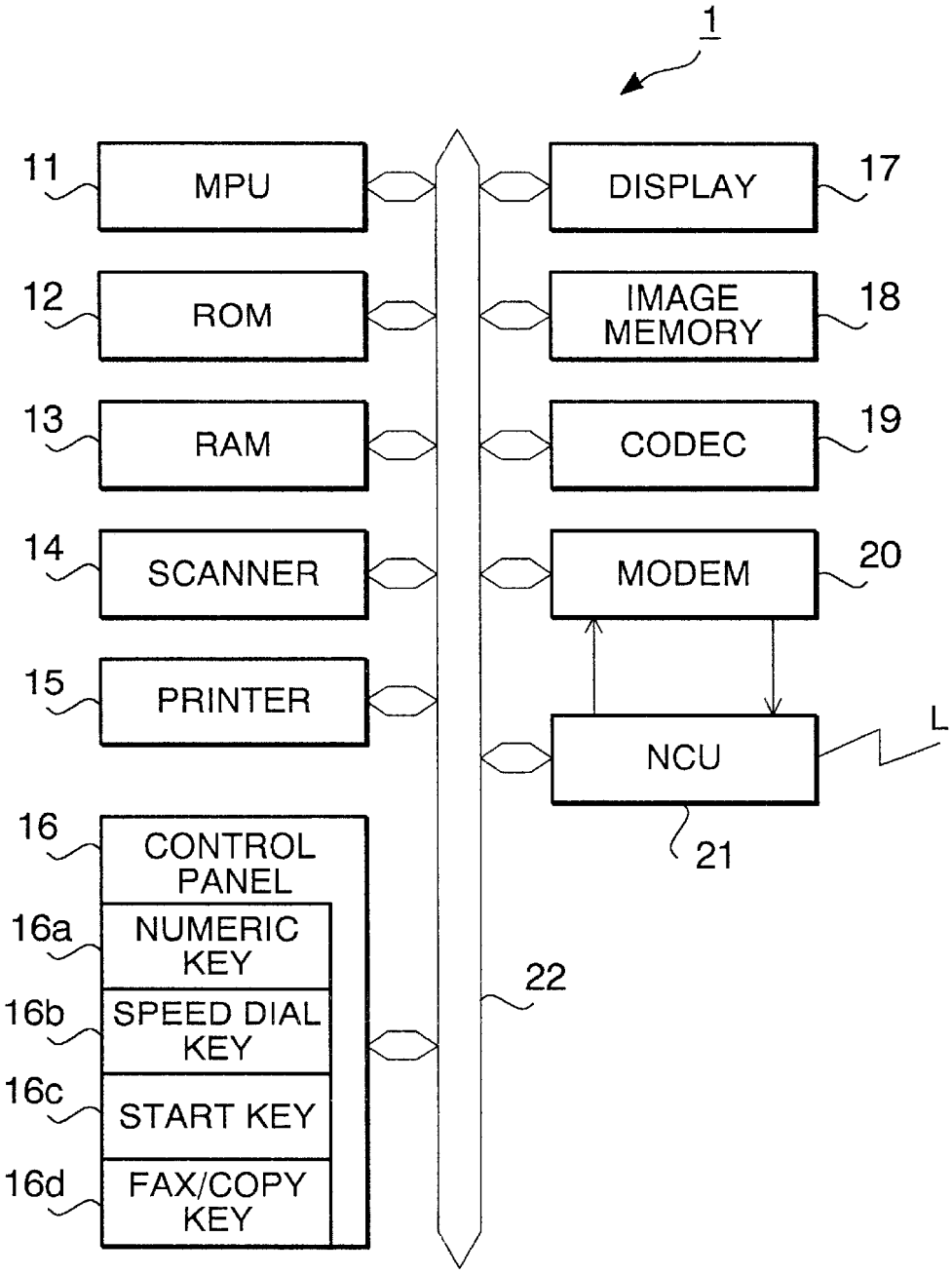
FIG. 1 illustrates a block diagram of a facsimile machine according to the present invention.

Referring to FIG. 1, the facsimile machine 1 includes MPU 11, ROM 12, RAM 13, scanning unit 14, printing unit 15, operating unit 16, display unit 17, image memory 18, CODEC 19, modem 20, and NCU 21. These elements 11 to 21 are interconnected over BUS 22.

MPU 11 controls the various elements of the machine 1, and ROM 12 stores programs used to control the machine 1. RAM 13 temporarily stores data used by the machine 1.

Scanning unit 14 scans a document and outputs binary image data. Printing unit 15 is an electro-photographic type printer, and capable of printing out onto a recording sheet image data received from a remote location, and image data of a document scanned by the scanning unit for copying. The printing unit 15 will be described in greater detail hereinbelow.

Operating unit 16 contains various keys that allow the user to operate the machine. These keys and controls include a numeric key pad 16*a* (also including number and pound keys) to allow input of telephone and facsimile numbers, a quick-dial key 16*b* to allow a user to input and register telephone and facsimile numbers using a quick dial number, a start key 16*c* through which the user can initiate scanning of a document, and a transmit/copy key (or fax/copy key) 16*d* to switch the machine 1 between facsimile transmission and copying.

Display unit 17 includes an LCD or the like, and indicates the operating status of the machine 1, as well as various other information.

Image memory 18 temporarily stores image data received from a remote source, or image data scanned by the scanning unit 14. CODEC 19 encodes the image data for transmission that is scanned by the scanning unit 14 using an appropriate encoding method, such as MH, MR, MMR, or the like, and also decodes image data received from a remote source.

Modem 20 modulates and demodulates data that is sent or received according to V.17, V.27ter, V.29 or the like, based on ITU-T recommendation T-30 facsimile transmission procedures. NCU 21 controls the establishment and breakage of connection with a telephone line L, sends dialing signals corresponding to remote facsimile numbers, and detects arrival of a call from a remote source.

The operation of the printing unit 15 will now be described in detail.

Figure 2:
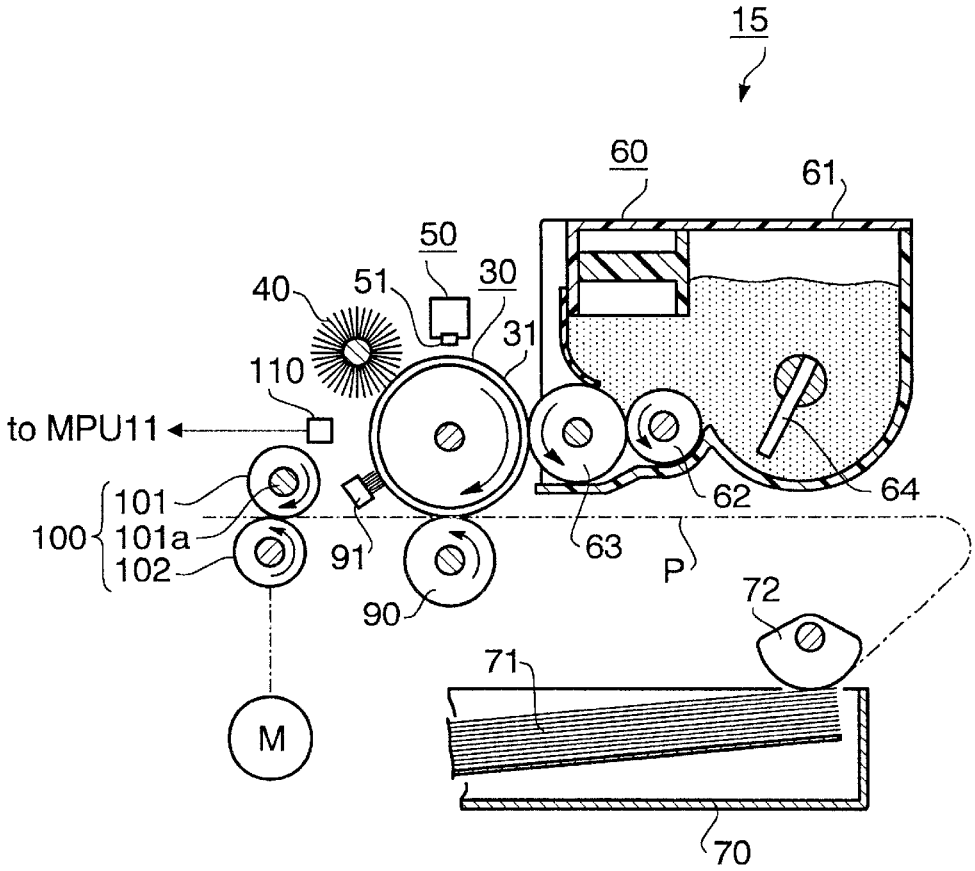
FIG. 2 is a cross-section view of a record unit employed in the facsimile machine shown in FIG. 1.

As illustrated in FIG. 2, a photosensitive drum 30 is supported by its axial shaft such that the drum 30 is rotatable. Photo-conductive film 31 is laid over the outer surface of the drum 30.

A charger 40, formed as a brush roller made of electro-conductive fiber, uniformly charges the photo-conductive film 31 on the drum 30 to a predetermined electric potential. Exposure unit 50, formed as an LED array 51, radiates light at the photo-conductive film 31 creating an electrostatic latent image.

Developer unit 60 is provided with a toner case 61 that holds toner, a supply roller 62 that is supplied with a predetermined voltage and arranged in the bottom portion of the toner case 61, and a developing roller 63, also supplied with a predetermined voltage, arranged in an opening at the bottom of the toner case 61 between the supply roller 62 and the photosensitive drum 30. The toner, which is transported from the toner case 61 by the supply roller 62 and developing roller 63, and which is charged to a predetermined polarity, is selectively applied to the electrostatic latent image based on the polarity of the toner and the difference in electrical potential between the developing roller 63 and the electrostatic latent image formed on the photosensitive drum 30. The toner that adheres to the electro-static latent image thus forms a toner image on the drum 30.

A stirrer 64 is rotatably supported inside the toner case 61. Rotation of the stirrer 64 agitates the toner inside the toner case 61, maintaining the toner at a uniform consistency.

Paper cassette 70 is capable of holding stacked sheets of recording paper 71 of a predetermined size. Semi-circular roller 72 feeds out the upper most sheet from the stack of paper 71 stored in the paper cassette 70 one sheet at a time. The sheet that is fed out 71 is transported towards photosensitive drum 30. The paper 71 follows the path indicated in the drawing by the chain-dotted line P.

A transfer unit 90 is arranged below photosensitive drum 30, and is controlled at a predetermined electrical potential. The difference in electrical potential between the transfer unit 90 and the photosensitive drum 30 causes the toner image to be transferred from the photosensitive drum 30 to the recording paper 71.

Memory removing brush 91 is formed as an electrically conductive brush, and functions to brush off any toner remaining on the photosensitive drum 30 after transfer such that the toner is uniformly dispersed on the photosensitive drum 30.

Fuser unit 100 includes a heat roller 101 and a nip roller 102, and is arranged downstream (in the direction of paper passage) from the photosensitive drum 30. A lamp 101*a* (a halogen lamp, for example) is arranged inside the heating roller 101 and maintains the fuser unit at a predetermined temperature. The fuser unit 100 melts the toner and fuses it to the paper 71 when the paper 71 is passed between the heating roller 101 and the nip roller 102.

A temperature sensor 110 is arranged in proximity to the fuser 100. The temperature sensor 110 is connected to MPU 11. The sensor detects the temperature of the fuser 100, and outputs the detected temperature to the MPU 11.

A motor M serves as the drive source for the printing unit 15, driving supply roller 62, developing roller 63, and other various rollers. In the present embodiment, the motor M may drive the entire facsimile machine 1. It should further be noted that in the present embodiment, the charging of the photosensitive drum 30 and the exposure, development, image transfer, and fusing processes are all performed sequentially, and together comprise a "printing process. "

Figure 3:
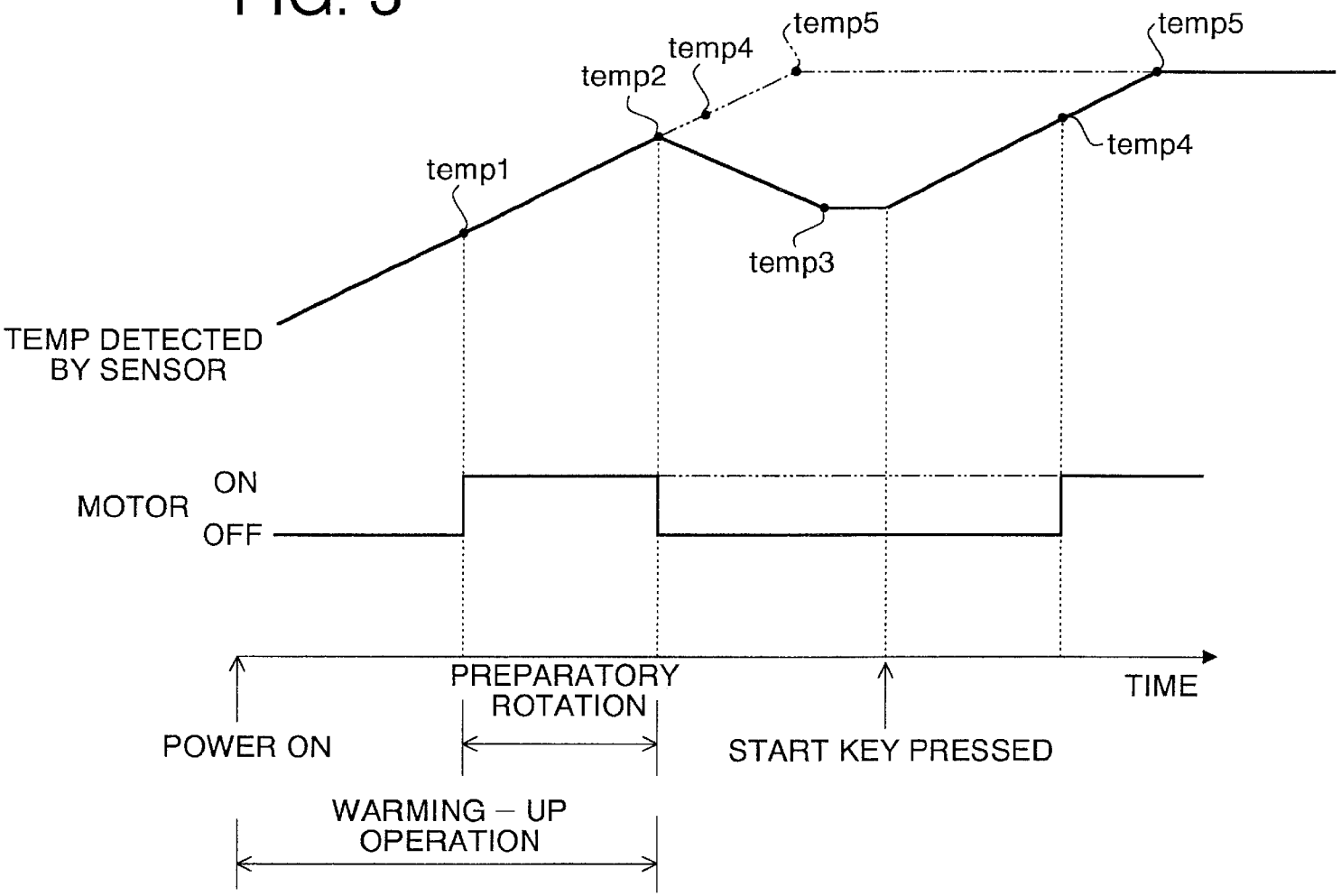
FIG. 3 is a time line showing relationship between motor operation and detected temperature from the time power is turned on in the facsimile machine to the time copying ends.
Figure 4:
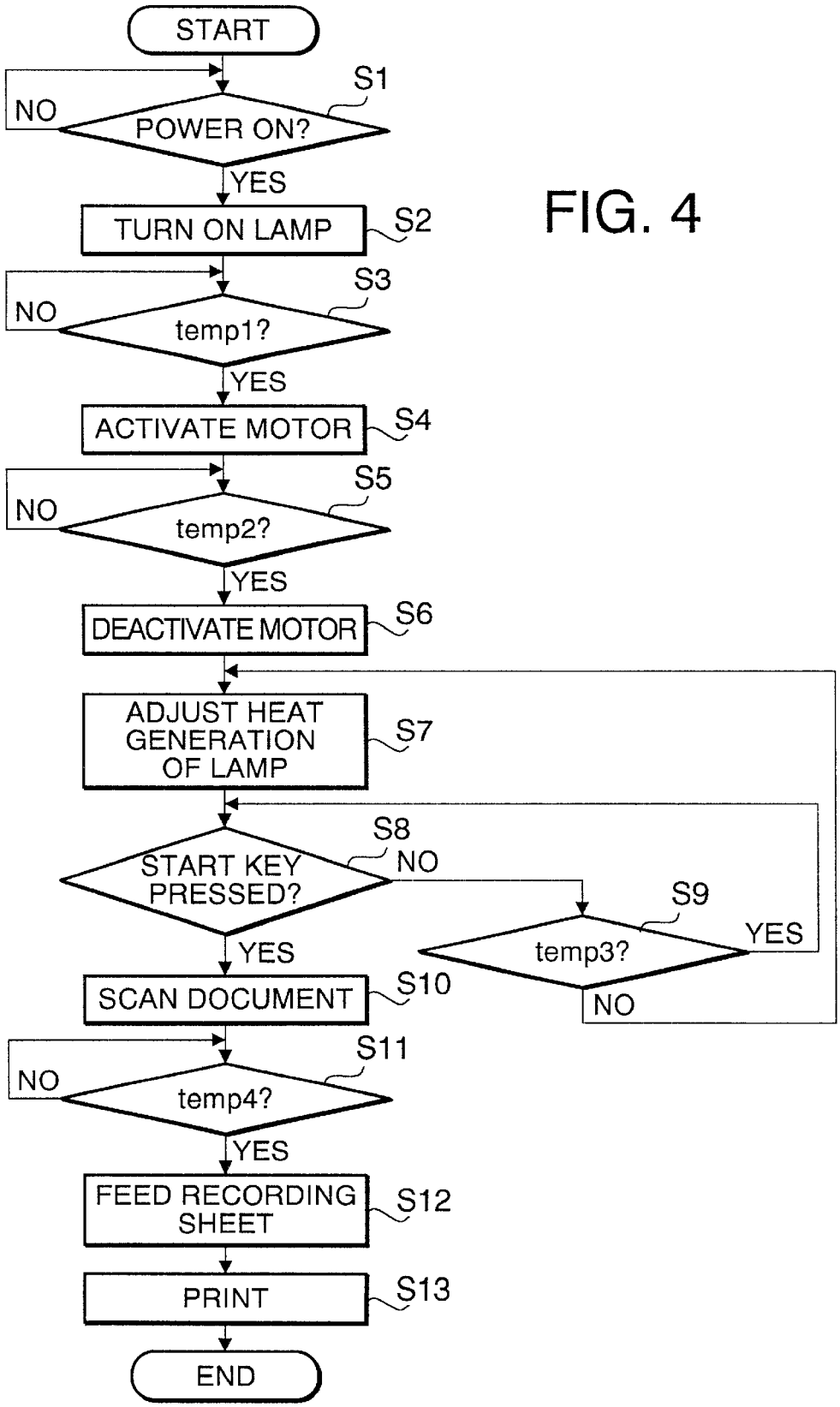

The operation of the facsimile machine 1 from the time it is supplied with power to the time it performs copying will now be described in detail with reference to the time line in FIG. 3 and the flow chart of FIG. 4. This operation is executed based on programs stored in the ROM 12, and performed under the control of MPU 11.

At step S1 the machine determines whether or not power has been turned on; if not, the program loops back in a stand-by mode, but when power is turned on, the machine 1 performs an initialization procedure and starts warm-up.

At step S2 lamp 101*a* is illuminated, and fuser 100 is heated.

At step S3 the machine 1 determines whether the temperature detected by temperature sensor 110 has reached a predetermined motor rotation starting temperature (temp 1) (100° C., for example); if not, the program loops back until the temperature reaches the rotation starting temperature.

At step S4 the motor M is rotated, and a photosensitive drum 30 preparatory rotation operation is initiated. The drum 30 preparatory rotation operation includes cleaning the surface of the drum 30, and collecting the toner gathered in the memory removing brush 91 at the developing roller 63 via the photosensitive drum 30.

At step S5 it is determined whether or not the temperature detected by the temperature sensor 110 has reached a warm-up completion temperature (temp 2). In the present embodiment, the warm-up completion temperature is set at 150° C. If not, the program loops back and repeats step S5 until the detected temperature reaches temp 2.

At step S6 the rotation of the motor M is stopped, and the preparatory rotation operation, is complete. In other words, the warm-up procedure finishes.

Next, at step S7 the amount of heat generated by the lamp 101*a* is adjusted such that the temperature of the fuser unit 100 reaches a predetermined stand-by temperature (temp 3). In the present embodiment, the stand-by temperature temp 3 is 100° C.

At step S8 it is determined whether or not the start key 16*c* has been pressed. If the key is pressed, the program advances to step S10. If not, the program advances to step S9.

At step S9 it is determined whether or not the temperature detected by the temperature sensor 110 is equivalent to the stand-by temperature temp 3. If so (step S9, YES) then the program returns to step S8; if not, then the program returns to step S7. It should be noted that the stand-by temperature temp 3 should be set at a temperature that allows the temperature of the fuser unit 100 to rise to the fusing temperature temp 5 from the stand-by temperature temp 3, enabling the image data to be properly recorded on the recording sheet 71, during the time period between when the recording sheet leaves the cassette 70 (after the start key 16c has been pressed) and reaches the fuser unit 100. It should be noted that since the warm-up completion temperature temp 2 higher than the stand-by temperature temp 3 is once reached before the start key 16*c* is pressed, the fuser's surrounding environment is already heated to a certain extent. Thus, the fuser 100 does not lose its heat to the surrounding environment. For such reason, the temperature of the fuser 100 is maintained at the stand-by temperature temp 3 in order to conserve power.

At step S10, an image of the document is scanned by the scanning unit 14.

The heat output of lamp 101*a* is adjusted based on the depression of the start key 16*c* at step S8, and at step S11 it is determined whether the temperature detected by sensor 110 reaches the print start temperature temp 4. If the answer is yes at step S1, the program proceeds to step S12.

At step S12 the motor is rotated, and a recording sheet 71 is transported from the paper cassette 70 towards the photosensitive drum 30.

At step S13 the image data is recorded onto the recording sheet 71 by the recording unit 15. When this happens, the temperature detected by the temperature sensor 110 has reached the fusing temperature temp 5. In other words, when the start key 16*c* is pressed thereby inputting a print command signal, the temperature of the fuser unit 100 is raised from the stand-by temperature temp 3 to the fusing temperature temp 5 during the time period between which the recording sheet 71 moves from the paper cassette 70 to the fuser unit 100.

As understood from the foregoing, the present embodiment can achieve the effects and advantages (1) to (5) described hereafter.

(1) The warm-up completion temperature temp 2 of the fuser unit 100 is set at a higher temperature than stand-by temperature temp 3. For this reason, the temperature of the environment around the fuser 100 is reliably raised when the application of heat to the fuser 100 is stopped. As a result, the heat of the fuser 100 is not lost to the surrounding environment, and the fuser can be brought quickly from the stand-by temperature 3 to the fusing temperature 5 when the start button 16*c* is pressed. Consequently, print-out can be performed quickly even if some time has passed since the heating of the fuser 100 has ended. In other words, print-out can be performed quickly even if some time has passed since completion of the warm-up operation.

(2) The warm-up completion temperature temp 2 is higher than the stand-by temperature temp 3, but lower than the fusing temperature temp 5. For this reason, the fuser 100 is not heated for an unnecessarily long period of time, and the power consumption needed to heat the fuser 100 can be restrained. Consequently, quick print-out can be performed upon pressing of the start key 16*c*.

(3) If the start key 16*c* is not pressed after heating of the fuser 100, the fuser 100 temperature is changed from the warm-up completion temperature temp 2 to the stand-by temperature temp 3. For this reason, the stand-by temperature temp 3 is maintained during stand-by mode, and power consumption can be reduced.

(4) When the fuser 100 reaches the motor rotation start temperature temp 1, preparatory rotation is initiated. When the fuser 100 reaches the warm-up completion temperature temp 2, the preparatory rotation is complete, and therefore the motor M is once stopped. Thus, the photosensitive drum 30 does not continue to rotate. Consequently, the wear-and-tear on the photosensitive drum 30 is minimized, and power consumption is reduced.

(5) After determining whether or not the fuser 100 has reached the print starting temperature temp 4, no determination is made on whether or not the fuser 100 has reached the fusing temperature temp 5. This is because the temperature of the fuser 100 can be raised from the stand-by temperature temp 3 to the fusing temperature temp 5 during the period in which a recording sheet 71 is transported from the paper cassette 70 to the fuser 100 after the start button 16c has been pressed. As a result, there is no need to halt the printing process (e. g., to postpone feeding the recording sheet 71) while waiting for the temperature to increase, and the processing time required by the print processing program can be reduced.

The present invention is not limited to the above described embodiment, and various changes and modifications may be made without departing from the spirit and scope of the invention. For example, following modification may be made:

1) Although the embodiment above discloses that preparatory rotation of the motor M begins when the temperature detected by temperature sensor 110 reaches the motor M rotation starting temperature temp 1, and the preparatory rotation ends when the temperature reaches the warm-up end temperature temp 2, the preparatory rotation may be made to end any time before printing of the image data begins.

2) When the present invention is employed in a facsimile machine, the machine may be set to detect inputting of a print command signal to MPU 11 upon facsimile reception instead of detecting the pressing of a start button 16*c*.

3) If the start key 16c is pressed (or some action causes a print signal to be given to the MPU 11) during the interval between the switching on of power and the end of the warm-up operation, the image of the document scanned by the scanning unit 14 may be temporarily stored in image memory 18. Alternatively, if facsimile reception occurs and a print command is input to MPU 11 during this interval, the received facsimile data may similarly be stored temporarily in the image memory 18. In such instance, paper 71 may be transported from the paper cassette 70 to the fuser 100 and printed without halting the rotation of the motor M after the fuser 100 has been heated (or in other words, once the warm-up completion temperature temp 2 is reached).

The illustrated and described image forming apparatus and warm-up method are disclosed in Japanese Patent Application No. 11-204367 filed on Jul. 19, 1999 in JPO and the instant application claims priority of this Japanese Patent Application, the entire disclosure of which is incorporated herein by reference.

What is claimed is:

1. A warm-up method for an image forming apparatus, comprising:

(a) starting a warm-up operation;

(b) activating a heating unit that heats a fuser, and starting the rotation of a motor that rotates a photosensitive body when the temperature of the fuser reaches a motor rotation starting temperature, (c) detecting the temperature of the fuser;

(d) determining whether or not the detected temperature of the fuser is equal to a warm-up completion temperature, the warm-up completion temperature being higher than the stand-by temperature; and (e) stopping the motor rotation and ending the warm-up operation when it is determined in step (d) that the temperature of the fuser has reached the warm-up completion temperature.

2. The warm-up method of claim 1 further including the step of (f) maintaining the temperature of the fuser at the stand-by temperature after step (e).

3. The warm-up method of claim 1 wherein the warm-up completion temperature is lower than a fusing temperature.

4. The warm-up method of claim 1 wherein the stand-by temperature is 100° C. and the warm-up completion temperature is about 150° C.

5. An electro-photographic image forming apparatus, comprising:

(a) means for starting a warm-up operation;

(b) means for activating a heating unit that heats a fuser, and starting the rotation of a motor that rotates a photosensitive body when the temperature of the fuser reaches a motor rotation starting temperature, (c) means for detecting the temperature of the fuser;

(d) means for determining whether or not the detected temperature of the fuser is equal to a warm-up completion temperature, the warm-up completion temperature being higher than the stand-by temperature;

(e) means for stopping the motor rotation and ending the warm-up, operation when it is determined in step (d) that the temperature of the fuser has reached the warm-up completion temperature; and (f) means for transporting a recording sheet from a paper cassette to the photosensitive body when the fuser reaches a print starting temperature.

6. The apparatus of claim 5, further including the means for maintaining the temperature of the fuser at the stand-by temperature.

7. The apparatus of claim 5, wherein the warm-up completion temperature is lower than a fusing temperature.

8. The apparatus of claim 5, wherein the stand-by temperature is about 100° C. and the warm-up completion temperature is about 150° C.

9. The warm-up method of claim 1, further comprising:

(f) transporting a recording sheet from a paper cassette to the photosensitive body when the fuser reaches a print starting temperature.

10. A warm-up method for an image forming apparatus, comprising:

(a) starting a warm-up operation;

(b) activating a heating unit that heats a fuser, and starting the rotation of a motor that rotates a photosensitive body;

(c) detecting the temperature of the fuser;

(d) determining whether or not the detected temperature of the fuser is equal to a warm-up completion temperature, the warm-up completion temperature being higher than the stand-by temperature;

(e) stopping the motor rotation and ending the warm-up operation when it is determined in step (d) that the temperature of the fuser has reached the warm-up completion temperature; and (f) transporting a recording sheet from a paper cassette to the photosensitive body when the fuser reaches a print starting temperature.

11. The warm-up method of claim 10, wherein (b) activating a heating unit that heats a fuser, and starting the rotation of a motor that rotates a photosensitive body, comprises:

(b) activating a heating unit that heats a fuser, and starting the rotation of a motor that rotates a photosensitive body when the temperature of the fuser reaches a motor rotation starting temperature.

* * * * *